United States Patent [19]

Buelens et al.

[11] Patent Number: 4,779,756

[45] Date of Patent: Oct. 25, 1988

[54] INJECTION-MOULDED MICROFILM CONTAINER

[75] Inventors: Edward Buelens, Kontich; Carolus C. Goossens, Berchem, both of Belgium

[73] Assignee: Agfa-Gevaert N.V., Mortsel, Belgium

[21] Appl. No.: 37,939

[22] Filed: Apr. 13, 1987

[30] Foreign Application Priority Data

Apr. 22, 1986 [EP] European Pat. Off. ..... 86200681

[51] Int. Cl.[4] ..... B65D 43/16

[52] U.S. Cl. ..... 220/307; 220/306; 220/337; 220/339

[58] Field of Search ..... 220/306, 307, 337, 339

[56] References Cited

U.S. PATENT DOCUMENTS

| | | | |
|---|---|---|---|
| 3,757,388 | 9/1973 | Wolny | 220/306 X |
| 4,211,337 | 7/1980 | Weavers et al. | 220/306 X |
| 4,303,176 | 12/1981 | Schwartzbaugh | 220/306 |
| 4,365,711 | 12/1982 | Long et al. | 220/306 X |
| 4,678,080 | 7/1987 | Nelson | 220/307 X |
| 4,733,796 | 3/1988 | Halverstadt et al. | 220/339 |

*Primary Examiner*—Stephen Marcus
*Assistant Examiner*—Nova Stucker
*Attorney, Agent, or Firm*—William J. Daniel

[57] ABSTRACT

An integrally injection-moulded rectangular microfilm container with a box section and a hinged lid section, which has cooperating snap-locking protections on lateral walls of the lid and of the box, such protections extending in a direction generally parallel with the rear walls and of the lid and box of the container, whereby easy unmoulding of the container from the mould is obtained.

9 Claims, 3 Drawing Sheets

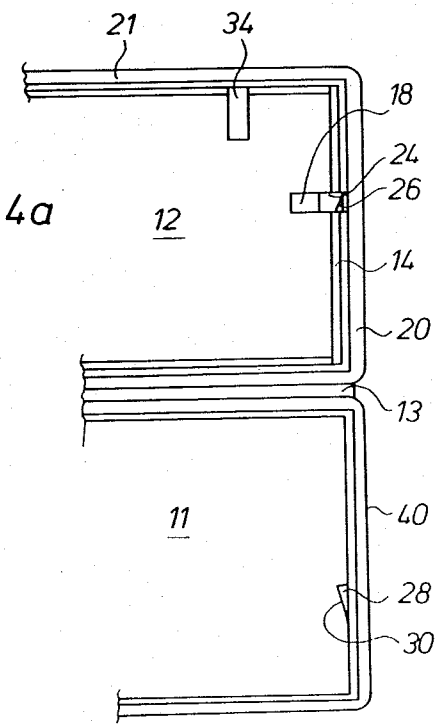
FIG. 4b
FIG. 4a
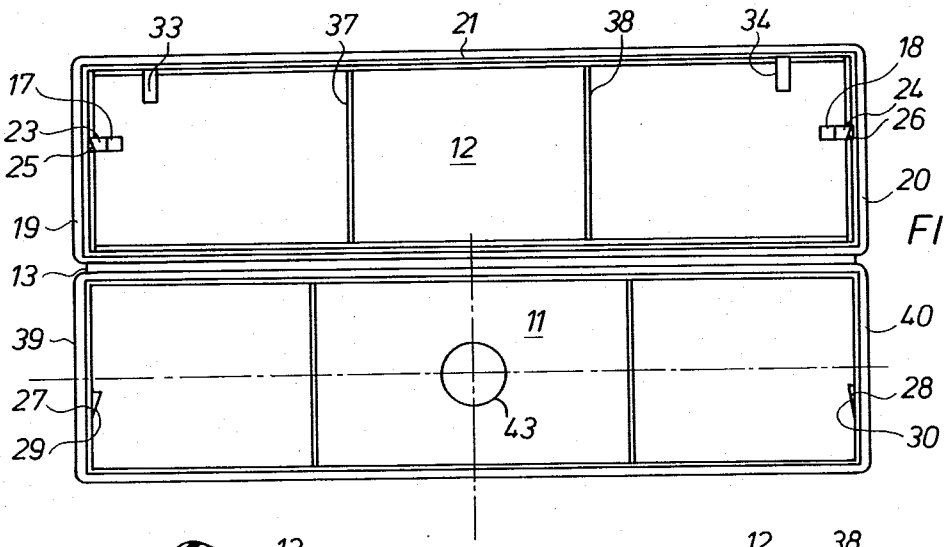
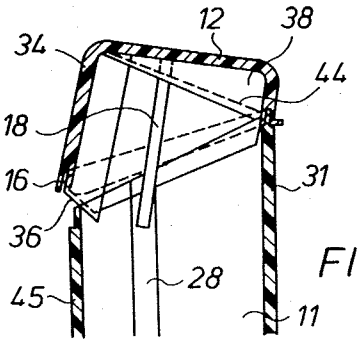
FIG. 6
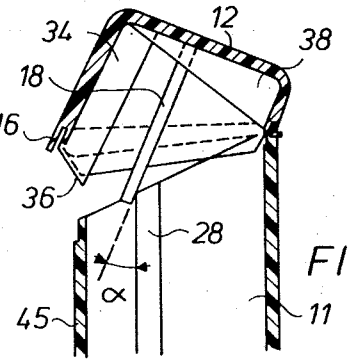
FIG. 5

INJECTION-MOULDED MICROFILM CONTAINER

DESCRIPTION

This invention relates to an injection-moulded generally rectanguloid light-tight container comprising box and lid portions which have meeting open ends which are connected together at rear walls of the box and lid by an integrally moulded hinge and which are provided with snap-locking means comprising co-operating formations on the lid and box for snap-locking the lid to the box against accidental opening.

Containers of this type are commercially used on a very wide scale for spools of 16 mm×30.5 m (100 ft) microfilm.

The containers are usually injection moulded from a black-pigmented plastics material, often polypropylene. Such moulding is effected with the container in the completely open condition, the lid requiring to be turned 180° from its closed position relative the box for closure, to assist unmoulding, that is, separation of the moulded container from its mould. It is also known in the art to design the mould so that none of the opposed wals of an injection-moulded component run strictly parallel with one another. In practice, a wall divergence towards the open ends of the component portions of about 15 to 20 minutes of arc or more is adopted in order to facilitate unmoulding, and in particular, with containers of the kind referred to, a wall of the lid portion, for example the rear wall, may be angled by up to 10° or even more.

A container with unexposed film is usually sealed against accidental opening by a label which is stuck on the lid, and/or by a wrapping foil which is heat shrunk onto the container, or by other means. It may happen that a user breaks the seal of one or several containers, and then decides either not yet to use all the unsealed films, or to use only a part of a film for carrying out microfilm recording. Also, the containers are commonly used as a convenient storage box in filing systems for exposed microfilms. Although light-tightness of the containers is relatively unimportant in this use, a reliable closure of the containers is still most desirable for handling during the developing and reviewing of the microfilms.

Containers are known of which the lid is provided with small ridges or the like leading along close to the open edge of the lid front wall, those ridges being arranged to co-operate with corresponding ridges near the open end of the front wall of the box, thereby to constitute a snap-locking system for locking the container closed against accidental opening. After the container has been opened for the first time, the snap-locking system is the only means on which the user can conveniently rely for keeping the container closed. A satisfactory locking system for the container is therefore indispensible in practice.

The cost of producing injection-moulded containers which are provided with locking ridges of that type to form a snap-locking system is increased because the moulds must be provided with movable parts which can be withdrawn from the main mould sections at the undercut locations behind the ridges in order to permit unmoulding of the containers. Moulds of this kind are expensive, and are subject to more maintenance than moulds without movable parts.

There are also known injection-moulded containers which are provided with locking means, the effect of which is based on a springy co-operation of two corresponding members. This kind of locking eventually leads to a relaxation, i.e., plastic deformation of the plastic material which results in a progressive reduction of the locking force.

It is an object of the present invention to provide an injection-moulded light-tight plastics container which can be injection-moulded by means of moulds which do not require movable parts in addition to the main mould sections in order to allow unmoulding of the container. In this way, the containers can be moulded in a more economical way.

According to the present invention, there is provided an injection moulded, generally "rectanguloid" light-tight container comprising box and lid portions or sections which have interfitting open ends which are connected together along their rear walls by an integrally moulded hinge and which are provided with snap-locking means comprising co-operating formations on the lid and box for snap-locking the lid to the box sections against accidental opening, characterised in that at least one lateral or side wall of the lid and the lateral wall of the box are each provided with an elongate snap-locking formation which leads towards the open end face of the respective portion, and in that the lengthwise direction of each such elongaged snap-locking formation and the lengthwise directions of the front and rear edges i.e. corner lines of the lateral wall on which it is formed extend in mutually non-convergent relation, i.e. parallel, towards the open end face of the respective portion.

By adopting the present invention, the direction in which the container is separated or removed from a main mould section can be determined by the lengthwise direction of the snap-locking formations, so that the previous requirement for complicated movable moulds is obviated.

The term "snap-locking" as used in the present specification stands for the locking obtained by means of two co-operating members that hook behind each other, with no notable bias in the closed position of the container.

In preferred embodiments of the invention, each snap-locking formation is formed on an interior surface of its respective lateral wall, at least one such formation being in the form of an internally projecting ridge which is parallel to the corners of the container and extends to the closed end of its respective lateral wall. This gives a clean appearance to the exterior surface of the container, while at the same time permitting the avoidance of any undercut mould region behind the ridge.

It would of course be possible for the snap-locking formations to be formed as a ridge on one portion of the container which co-operates with a groove on the other. However this entails that the lateral wall in which the groove is formed should be made rather thick in order that it shall have sufficient strength over the length of that groove. Also it can lead to excessive wear of the co-operating ridge. Preferably, therefore, each said snap-locking formation is constituted by a ridge which extends to the closed end of its respective lateral wall.

In order to promote a more secure closure, it is preferred that a said snap-locking formation is provided on both lateral walls of the lid and the box.

In preferred embodiments of the invention, the or each snap-locking formation on the box extends up to the open end face thereof, and the or each snap-locking formation on the lid is constituted by a tongue which projects beyond the open end face of the lid. This is found to facilitate the introduction of contents into the box portion as compared with embodiments in which a ridge projects from the open end of the box.

Advantageously, the outer end of the outer face of each snap-locking tongue on the lid which will first engage the corresponding snap-locking formation on the box is bevelled inwardly and downwardly so that it is oriented obliquely in the closed end or top to open end direction of the lid, and preferably also, the inner face of each snap-locking ridge on the lid which will next engage the corresponding snap-locking formation on the box is bevelled inwardly from front to rear. The adoption of each of these features contributes to a smooth interengagement of the snap-locking formations.

Preferably, each snap-locking formation on the lid is constituted by a tongue ridge which projects internally a distance from its lateral wall which distance is greater than the width of the ridge measured in the front to rear direction of the container i.e., parallel to the lateral wall. This promotes a secure interengagement of the snap-locking formations while being economical of moulded material.

Some preferred embodiments of the invention have the feature that the lid is provided with at least one rib on the interior surface of its closed end wall i.e., the top wall, the free edge of each such rib being sloped so that it decreases in height from the rear wall to the front wall of the lid. Such a rib is useful for clamping contents, for example a microfilm spool into position in the container when the latter is closed, and the provision of such a rib which slopes is advantageous for trimming the rib to size should this be necessary to effect such clamping. It is also desirable that such rib should decrease in height from the rear to front of the lid so that clamping forces on a microfilm spool are exerted on the rear flange of that spool. It is to be noted here that some known microfilm containers are provided with an internal rib in their lids which slopes in the opposite direction so that such rib exerts clamping forces on the front flange of a spool. Arranging such a rib so as to exert clamping forces on the rear flange of a spool has the important advantage of relieving counteracting forces exerted between the snap-locking formations because they can easily be located further away from the hinge than the rear spool flange, thus leading to a more secure closure of the container against accidental opening.

The invention will now be described in greater detail by way of example only with reference to the accompanying diagrammatic drawings, in which.

Figure 1:
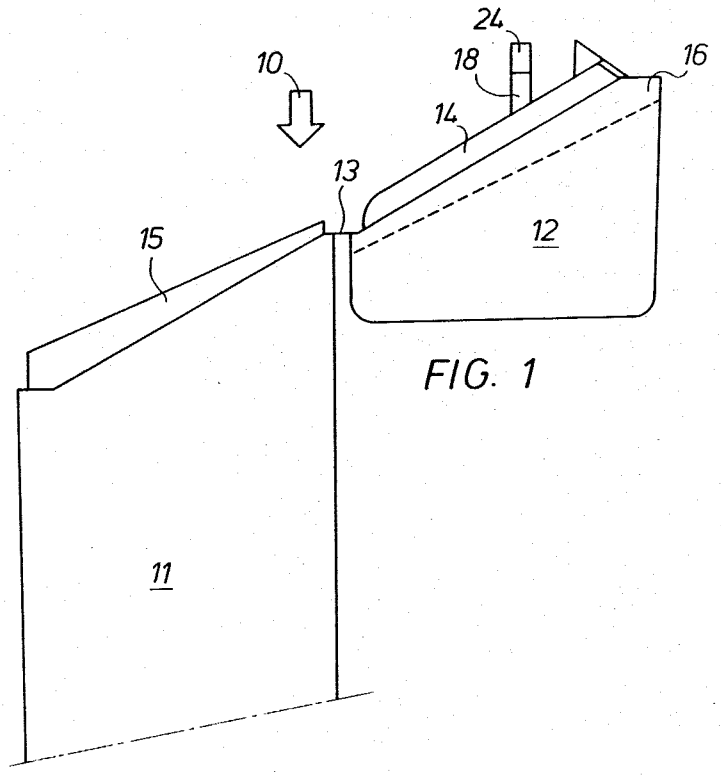
FIG. 1 is a side elevation of the upper part of an embodiment of container in accordance with the present invention, the lid being shown in its fully open position in which the container as a whole is removed from its mold.

FIG. 4*a* is a plan view of the container shown in FIG. 1;

FIG. 4*b* is a detail to an enlarged scale of part of FIG. 4*a;*

FIG. 5 is a detail cross sectional view from the side of the container of FIG. 1, showing the lid in a position where the snap-locking formations first come into contact; and FIG. 6 is a detail cross sectional view from the side of the container of FIG. 1, showing the lid in a position with the snap-locking formations in contact but prior to locking.

Referring to FIG. 1, a light-tight container 10 is illustrated which comprises a generally rectangular box 11 and a generally rectangular lid 12 which are interconnected by a hinge 13. The container has been manufactured by injection-moulding from suitable plastics, such as black-pigmented polypropylene and the hinge has been integrally moulded together with the box and the lid. The moulding of the container occurs with the lid in a position as illustrated in FIG. 1, and the unmoulding of the container occurs by the vertical removal of the inner part of the mould from the outer part, and then the ejection of the moulded assembly from the outer part of the mould.

The lid 12 is provided with an inner peripheral wall portion 14 which fits behind a peripheral wall portion or lip 15 of the box, whereas the latter peripheral wall portion or lip 15 fits into a peripheral groove 16 in the open end edges of the lid inside its lip 14. The peripheral groove 16 extends in depth to the limit indicated by the broken line in FIG. 1. The container can thus form a light-tight receptacle for a spool carrying a roll of unexposed light-sensitive film due to the overlap of lips 14 and 15 and the seating of lip 15 into groove 16.

The box 11 has only partly been illustrated in FIG. 1. The full height of the box amounts in practice to approximately 4 times the depth of the box.

The container according to one illustrative embodiment is now described in further detail, with reference to FIGS. 1 to 4.

Figure 3:
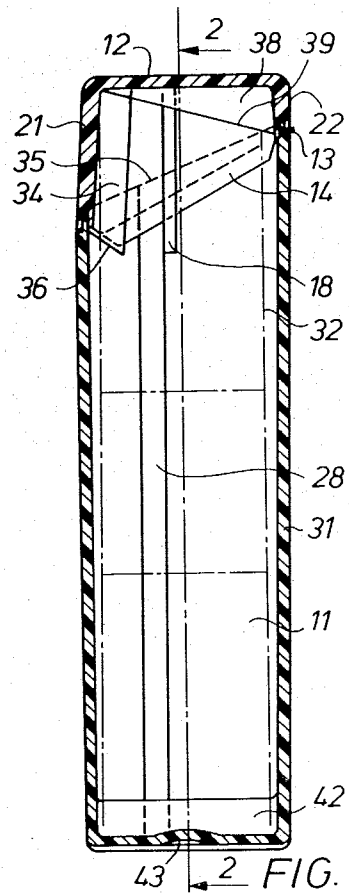
FIG. 3 is a cross sectional view from the side of the container of FIG. 1, along the line 3—3 of FIG. 2.
Figure 2:
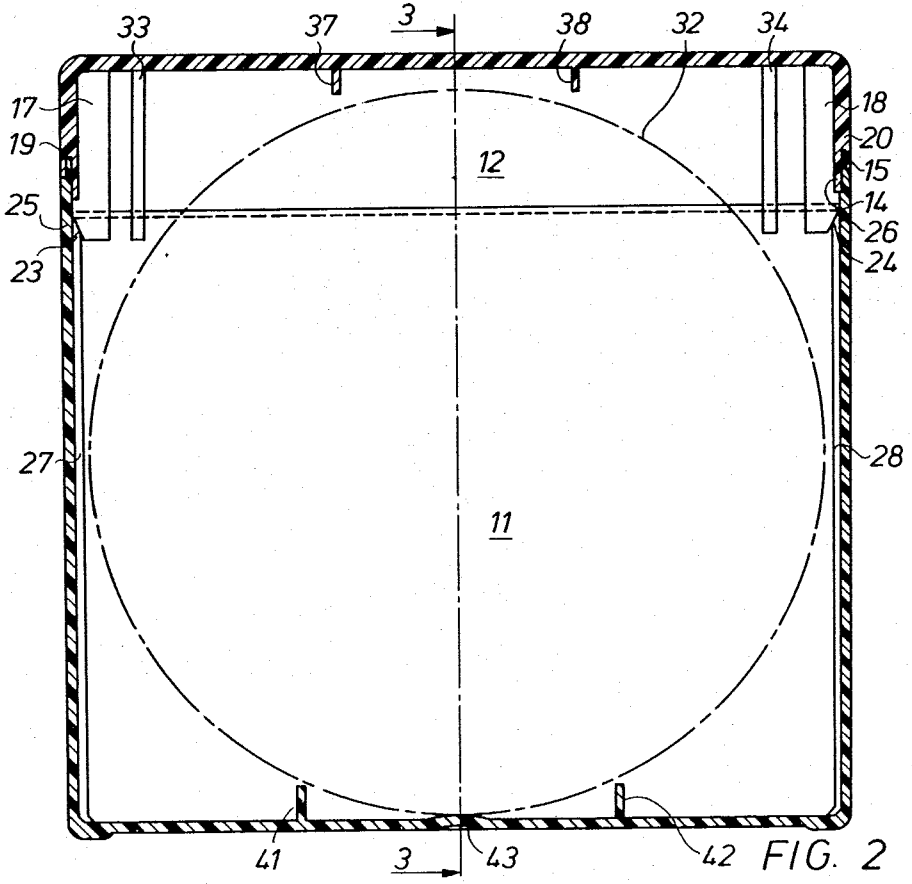
FIG. 2 is a cross sectional view from the front of the container of FIG. 1, along the line 2—2 of FIG. 3.

The lid 12 is provided with two internally projecting ribs 17 and 18 on the interior surface of its lateral or side walls 19 and 20. As best seen in FIG. 3, those ribs 17 and 18 and the front and rear walls 21,22 of the lid 12 (which define the corner edges of its side walls 19,20) are all slightly mutually divergent in the downward direction of FIG. 3, towards the open end face of the lid. The ribs extend outwardly beyond the lower edge of lid lip 14 to form tongues, as may be most clearly seen in FIG. 1 for the rib 18, and the ribs are provided adjacent their free ends laterally facing bevelled outside faces, when viewed in front elevation 23 and 24. These faces are oriented obliquely inwardly from the closed end or top to open end direction of the lid which helps guide the externally projecting tongues into the opening of the bottom section 11.

Other outer face section 25,26 of the ribs that are located between the bevelled faces 23 and 24, and the free edge of the lid lip 14, are also bevelled inwardly from front to rear when viewed in plan, see especially FIGS. 4*a* and 4*b*. The exterior tongue sections of the ribs bounded by these faces 25,26 form one half of the co-operating interlocking closures of the container.

The box 11 of the container is provided with two locking ridges 27 and 28 moulded on the interior surfaces of its lateral or side walls 39, 40 of the box, and they extend vertically over the full height of the box, up to the fre edge of the box lip 15 as illustrated by the broken line 35 in FIG. 3, that lip being obscured by lid lip 14. The ridges have slanting surfaces 29 and 30 inwardly from front to rear, and they form the other half of the co-operating interlocking closure of the container. As best seen in FIG. 3, those ridges 27,28 and the front and rear walls 45,31 of the box (which define the corner edges of its lateral walls 39,40) are all slightly mutually divergent in the upward direction of FIG. 3, towards the open end of the box.

The lid of the container is further provided with two ribs 33 and 34 on the inner surface of the front wall 21 of the lid. The ribs have slanting end faces such as the face 36 shown for the rib 34, see FIG. 3. The purpose of these slanting end faces of the ribs is to cause a gentle pressure on the upper end of the front wall 45 of the box when the lid is closed. In this way the free end faces of the ribs have a redressing action on the front wall of the box which has an inherent tendency to curve inwardly of the box, and thus the closing of the container occurs smoothly.

The lid 12 is finally provided with two laterally spaced locking ribs 37 and 38 the purpose of which is to engage the rear flange of a film spool in the container, as described already in the introduction of this specification. To that end, the free edges of said ribs are sloped as illustrated by the edge 39 of the rib 38 in FIG. 3. The engagement of the rear flange of a spool by the wedge-like ribs is illustrated in FIG. 3 for a spool 32, the contour of which has been illustrated in dash-and-dot lines. This rib configuration, which differs from ribs known in the art which have their greatest height near the front wall of the lid, has the advantage that the force for the clamping engagement of the spool acts now much closer to the hinge of the lid so that the counter-acting force at the snap-locking of the lid (which tends to open the lid), is much smaller than in the case when the contact of the rib with the spool flange occurs at the front of the container.

The bottom wall of the box is provided with two laterally spaced ribs 41 and 42 which support the film spool in spaced contact from the said wall. The bottom wall of the box also has a small dome portion 43, at the under side of which is located the injection point for the injection-moulding of the container.

The operation of the container will now be described with particular reference to FIGS. 1, 4, 5 and 6.

The container being opened as illustrated in FIG. 1, a film spool that comprises a roll of either exposed or unexposed film, is inserted into the box, whereupon the lid is closed.

In a first part of the closing operation, the lid is swung until an angular position as illustrated in FIG. 5 is obtained. In that position, the first bevelled faces 23 and 24 of the ribs 17 and 18 enter into contact with the upper edge of the slanting surfaces 29 and 30 of the ridges 27 and 28 in the box. Further lowering of the lid causes the contact of the box ridges with the lid ridges to move from the first bevelled faces 23, 24 towards the second bevelled faces 25 and 26 of the ribs 17 and 18. The contact between the surfaces of the co-operating ridges causes the ridges to smoothly slide over each other, thereby urging the lateral walls of the box slightly outwardly and the lateral walls of the lid slightly inwardly, under the increasing mutual pressure of the ridges. The angle # (FIG. 5) between the co-operating ridges which amounted to approximately 30° at the moment of first contact, progressively decreases towards zero as the lid is further closed.

As the lid is urged further towards the closed position, there comes a moment at which the free edges 36 of the ribs 33 and 34 just engage the upper edge of the front wall 45 of the box, see FIG. 6. The end of the closing operation of the lid causes the edges 36 to slide behind the front wall 45 and they urge an occasionally inwardly deformed wall in an outward direction, so that such deformed wall becomes straightened, in accordance with the position of such rib edges.

At the moment the angle # has become zero, the ridges of the lid have completely moved past each other, and the snap-locking of the ridges under the elastic recovery forces of the corresponding lateral walls of the container has been obtained. The mutual position of a pair of co-operating ridges in the closed position of the lid is illustrated in FIG. 3 for the ridges 18 and 28.

At the moment the ridges lock behind each other, the slanting end faces 36 of the ribs 33 and 34 have completely passed over the upper edge of the front wall of the box, and the end portions of said faces snap behind said front wall, thereby adding supplemental securing to the locking obtained already by the ridges 17, 18 and 27, 28.

At the moment the lid was completely closed, the ribs 37 and 38 entered into contact with the rear flange of the microfilm spool in the container, thereby centering the spool in the container and also immobilising the spool in the container.

A container loaded with a spool of unexposed light-sensitive film as described, may be sealed by means of an identification seal stuck on the front of the container over the lid and the box, it may be wrapped in a transparent or opaque foil that also may bear identification data for the photographic material, etc.

The locking ridges of the container described hereinbefore, all run in a longitudinal direction which is parallel with the direction of unmoulding of the container, and they are free of undercuts or the like. In this way, these ridges do not interfere with the unmoulding of the container, and therefore the mould components may comprise an outer and an inner main mould section, without any displaceable elements being required in those main sections to allow the proper unmoulding.

A container according to the present invention is not limited to the described embodiment.

A co-operating groove-and-tongue engagement between lid and box may be omitted, and in such absence of an inner wall portion in the lid, the locking ridges of the lid may also be formed by ribs that are freely vertically projecting from the interior of the top wall of the lid, stiffened as the case may be by small side ribs that increase the rigidity of such ribs.

The container according to the invention may optionally comprise more than one pair of co-operating locking ridges on each lateral wall.

The container according to the invention may optionally be adapted for accepting two types of microfilm spools. As a matter of fact, in the case of 16 mm microfilm spools, the spool onto which the unexposed film is wound have a diameter of 91.7 mm (max. 91.95 mm), whereas spools onto which the exposed and processed film is wound and that are intended for use in a microfilm reader or printer or for storage of the film, have a diameter of 92 mm (max 94.0 mm). The latter spools are futher usually transparent, and they have a radial slot which facilitates the threading up of a film.

A container according to the present invention that is originally designed for receiving such recording-type spools, may be arranged for receiving also the reading-type spools, by the simple cutting away of a portion at the free edge of the locking ribs 37 and 38, as indicated by the broken line 44 in FIG. 6, for example using ordinary scissors. This operation is much facilitated by the location of the highest point of the ribs close to the hinge of the container.

We claim:

1. An injection-moulded generally retanguloid container comprising a box section having generally parallel opposite side walls, front, back and bottom walls and an open end opposite said bottom wall, and a lid section for closing the open end of said box section opposite said bottom wall, said lid section being integrally hinged to said box section along the top of its rear wall, and being swingable about said hinge between open and closed positions, said lid section having an extension on at least one of its sides projecting downwardly when in its closed position into overlapping relation with and in close proximity to the corresponding side wall of said box section adjacent its open end, and cooperating snap-locking means on said lid and box sections, said snap-locking means comprising an elongated ridge on each such corresponding side wall of said box section toward the overlapping extension of said lid section at a locus intermediate the front and rear edges of said side wall, said ridge extending along at least the region of said side wall generally adjacent the open end of said box section in a direction generally parallel to the direction of the front and rear edges of said side wall; and a cooperating protrusion on said lid section extension toward the overlapping side wall of said box wall, said protrusion of said extension and said ridge when said lid section is in closed position being disposed in overlapping juxtaposed relation with the cooperating protrusion located nearer the back wall of said box section than said ridge, whereby when said lid section is pivoted from open to closed position, said cooperating protrusion moves with said lid section bodily along an arcuate path crossing the length of said ridge, with at least one of said protrusion and ridge resiliently yielding to temporarily remove the overlap therebetween during such crossing movement, to bring said protrusion and ridge to said overlapping juxtaposed relation.

2. The container of claim 1, wherein each said ridge is formed on the interior face of said side wall of said box section and said extension on said lid section comprises a tongue with its free end partially intruding through the open end of said box section into its interior adjacent a side wall having a ridge thereon, said tongue having a lateral edge protruding toward said side wall into overlapping juxtaposition with the interior ridge of said box section.

3. The container of claim 1, wherein each said ridge on a side wall of said box section has a sloping face inclined relative to the plane of its side wall inwardly from front to rear thereof.

4. The container of claim 1, wherein each such cooperating protrusion on an extension of said lid section has a sloping face that is inclined relative to the plane of the side wall carrying the ridge cooperating therewith inwardly from front to rear.

5. The container of claim 3, wherein each such cooperating protrusion on an extension of said lid section has a sloping face that is inclined relative to the plane of the side wall carrying the ridge cooperating therewith inwardly from front to rear.

6. The container of claim 2, wherein said tongue is beveled at its free end to guide said tongue when moving to its closed position into the interior of said box section.

7. The container of claim 1, wherein said lid section includes a top wall and opposite side walls and a front wall depending therefrom.

8. The container of claim 7, wherein the opposite side wall and front wall of one of said lid and box section are re-entrantly grooved along the free ends thereof and the opposite side walls and front wall of the other of said sections carries a lip of reduced thickness for insertion into said groove upon closure of said lid section.

9. The container of claim 7, wherein the free ends of the opposite side walls of each of the lid and box sections extends at an oblique angle relative to the plane of the associated front wall, the oblique angle of the two sections being complementary.

* * * * *